US007371097B1

(12) United States Patent
Pennypacker et al.

(10) Patent No.: US 7,371,097 B1
(45) Date of Patent: May 13, 2008

(54) SOCKET CONNECTOR WITH LATCH LOCKING MEMBER

(75) Inventors: Jeffrey Pennypacker, Harrisburg, PA (US); Richard Nicholas Whyne, Camp Hill, PA (US); Daniel Robert Ringler, Elizabethville, PA (US); Attalee S. Taylor, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/703,935

(22) Filed: Feb. 7, 2007

(51) Int. Cl.
*H01R 13/62* (2006.01)

(52) U.S. Cl. ..... 439/327

(58) Field of Classification Search ..... 361/801; 439/326–328, 629–637; 436/629–637
See application file for complete search history.

(56) References Cited

U.S. PATENT DOCUMENTS 5,443,394 A 8/1995 Billman et al.
5,445,531 A 8/1995 Billman et al.
5,494,451 A * 2/1996 Bowers ..... 439/328
5,668,348 A * 9/1997 Lin ..... 174/16.3
5,690,499 A 11/1997 Howell
5,726,865 A * 3/1998 Webb et al. ..... 439/328
5,851,964 A * 12/1998 Furey et al. ..... 508/243
5,943,218 A * 8/1999 Liu ..... 361/801
6,056,579 A 5/2000 Richards, III et al.
6,132,248 A 10/2000 Ramey
6,394,831 B1 5/2002 Bowers et al.
6,517,369 B1 * 2/2003 Butterbaugh et al. ..... 439/327
6,616,466 B2 9/2003 Frantum, Jr. et al.
6,769,927 B2 8/2004 Brewer
7,121,862 B2 * 10/2006 Tang et al. ..... 439/327

* cited by examiner

*Primary Examiner*—Briggitte R. Hammond

(57) ABSTRACT

A socket connector for connecting a card edge module to a circuit board includes a housing extending along a longitudinal axis between opposed ends. The housing includes a mounting face configured to be received on the circuit board and a slot configured to receive a mating edge of the card edge module. A latch member is pivotably connected to the housing. The latch member is movable between an open position and a closed position. A locking member is positioned on the latch member and configured to prevent movement of the latch member from the closed position to the open position.

19 Claims, 10 Drawing Sheets

SOCKET CONNECTOR WITH LATCH LOCKING MEMBER

BACKGROUND OF THE INVENTION

The invention relates generally to socket connectors for retaining card edge modules and, more particularly, to a socket connector having features for locking module retention latches on the connector in a closed position to retain the card edge module within the socket.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), or the newer Dual In-line Memory Modules (DIMM's) and Fully Buffered DIMM's (FB DIMM's).

Typically, the modules are installed in one or more multi-pin sockets mounted on a system board or motherboard. Each memory module has a card edge that provides an interface generally between two rows of contacts in the socket. Conventionally, the card edge interface is a separable card edge interface. These card edge interfaces, however, are generally not high reliability interfaces. The modules are generally held in the socket by latches on the socket and by contact normal forces. These card edge interfaces may fail when subjected to shock and vibration. Under extreme vibration, and particularly with the heavier FB DIMM's, the latches may be jarred open allowing the module to become dislodged. During vibration, the module may also experience sufficient motion within the socket to cause fretting of the gold on gold contact interfaces which increases resistance and may cause failures.

One approach for increasing reliability of the card edge interface is to directly attach the module via an inseparable interface. This is sometimes done when it is desirable that the end user not be able to remove processors or memory modules from the system so that problems that might arise from reconfiguration of the system do not occur; however, this renders the module non-serviceable. The provision of a highly reliable serviceable interface that limits movement of the module within the socket while inhibiting the module from becoming dislodged from the socket remains a challenge.

BRIEF DESCRIPTION OF THE INVENTION

In one embodiment, a socket connector for connecting a card edge module to a circuit board is provided. The socket connector includes a housing extending along a longitudinal axis between opposed ends. The housing includes a mounting face configured to be received on the circuit board and a slot configured to receive a mating edge of the card edge module. A latch member is pivotably connected to the housing. The latch member is movable between an open position and a closed position. A locking member is positioned on the latch member and configured to prevent movement of the latch member from the closed position to the open position.

Optionally, the latch member includes a first latch member at one of the opposed ends of the housing and a second latch member at the other of the opposed ends of the housing and wherein the locking member engages the first and second latch members to prevent movement of the first and second latch members from the closed position to the open position. The locking member includes an opening sized to receive a protrusion on said latch member and a slot sized to receive a portion of the card edge module. The locking member is configured to apply a downward load on the card edge module to bias the card edge module toward the slot. Alternatively, the locking member is mounted on the latch member and is slidable between a locked position and an unlocked position. The opposed ends includes a protrusion having an engagement surface and the locking member includes a lip that engages the engagement surface when the locking member is in the locked position.

In another embodiment, a socket connector for connecting a card edge module to a circuit board is provided. The socket connector includes a housing extending along a longitudinal axis between opposed ends. The housing includes a mounting face configured to be received on the circuit board and a slot configured to receive a mating edge of the card edge module in a loading direction. A latch member is pivotably connected to the housing. The latch member is movable between an open position and a closed position. A locking member is positioned on the latch member. The locking member includes a tab that is moved simultaneously in the loading direction and a longitudinal direction to enable the latch member to be moved to the open position.

DETAILED DESCRIPTION OF THE INVENTION

Figure 1:
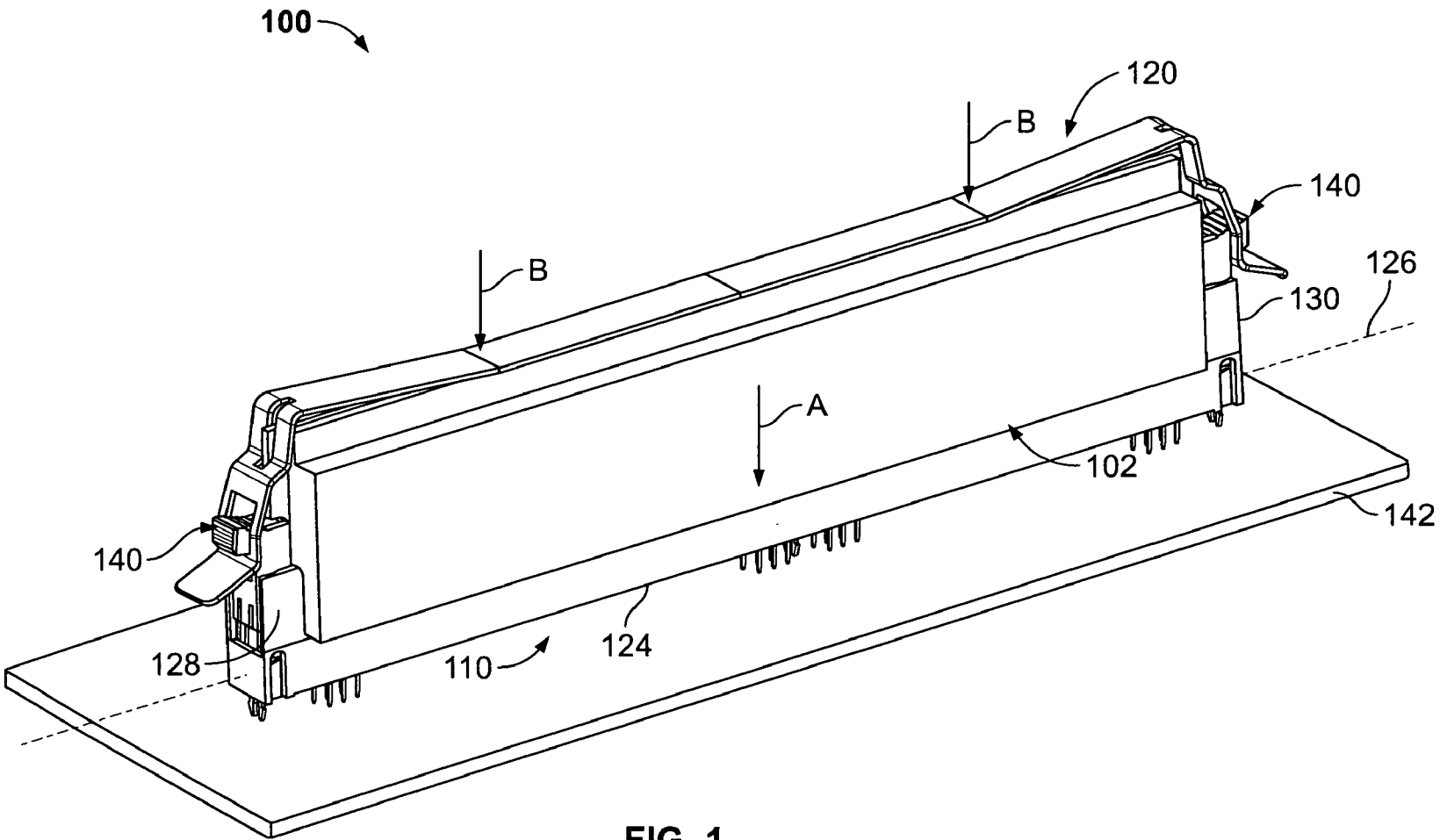
FIG. 1 is a perspective view of an electronic assembly including a socket connector and locking member formed in accordance with an exemplary embodiment of the present invention.

FIG. 1 illustrates an electronic assembly 100 including a card edge module 102, a socket connector 110, and a locking member 120 formed in accordance with an exemplary embodiment of the present invention. The locking member 120 is configured to prevent dislodgement of the card edge module 102 from the socket connector 110. The connector 110 includes a dielectric housing 124 that extends along a longitudinal axis 126 between opposite ends 128 and 130. Latch members 140 are pivotably connected to the housing 124 at the ends 128 and 130. The latch members 140 are pivotable between an open position and a closed position. The card edge module 102 is loaded into the connector 110 in the direction of the arrow A when the latch members 140 are in the open position. The card edge module 102 is held in the connector 110 when the latch members 140 are in the closed position. The locking member 120 is positioned on the latch members 140 and is configured to prevent movement of the latch members 140 from the closed position to the open position to thereby prevent dislodgement of the card edge module 102 from the socket connector 110 as will be described. To further secure the card edge module 102 in the connector 110, the locking member 120 is configured to bias the card edge module 102 in the loading direction A through the application of a downward biasing load B on the card edge module 102 parallel to the loading direction A. The connector 110 is configured to be mounted on a circuit board 142.

Figure 2:
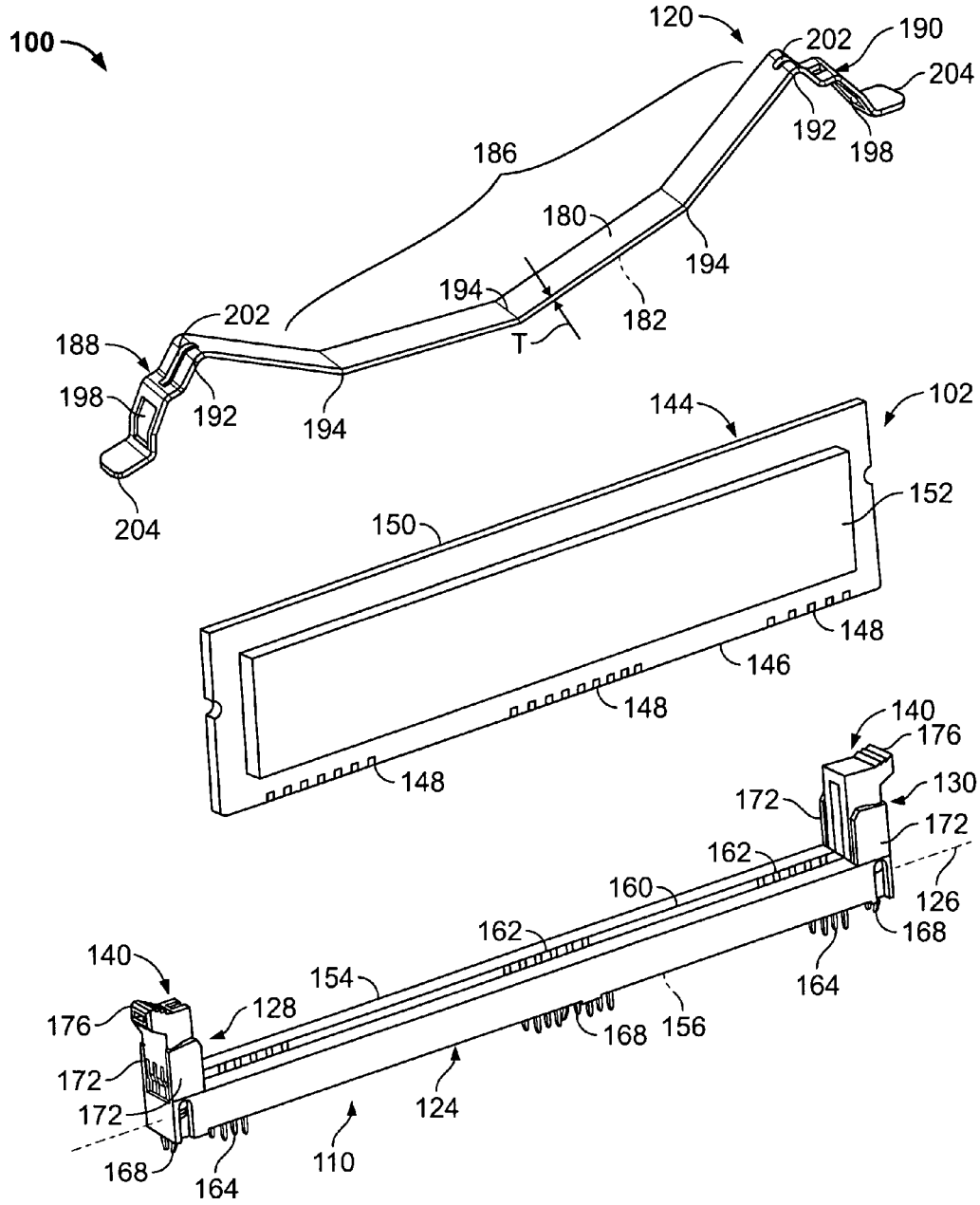
FIG. 2 is an exploded view of the electronic assembly shown in FIG. 1.

FIG. 2 illustrates an exploded view of the assembly 100. The card edge module 102 includes a planar substrate 144 that has a mating edge 146 and a plurality of electrical traces (not shown), each of which terminates at a respective contact pad 148 on the mating edge 146. The substrate 144 includes an upper edge 150 opposite the mating edge 146 and also includes surface mounted components generally represented at 152.

The housing 124 of the connector 110 includes an upward facing mating face 154 and a mounting face 156. The housing 124 includes a longitudinally extending slot 160 that is configured to receive the mating edge 146 of the card edge module 102. The housing 124 holds a plurality of electrical contacts 162 arranged in rows on each side of the slot 160. The contacts 162 include contact tails 164 that are configured to be received in apertures (not shown) in the circuit board 142 (FIG. 1). The housing 124 may also include board locks 168 for securing the connector 110 to the circuit board 142. In alternative embodiments, the connector 110 may be surface mounted to the circuit board 142 and may or may not include board locks 168.

Each connector end 128 and 130 includes upwardly extending and spaced-apart side panels 172. The latch members 140 are positioned between the side panels 172 and are pivotably connected to the ends 128 and 130. The latch members 140, which may also be referred to as extractors, are movable between an open position to receive the card edge module 102 in the connector 110 and a closed position to retain the card edge module 102 in the connector 110. Protrusions 176 extend outwardly from each latch member 140 and may be used for manipulating the latch members 140.

The locking member 120 includes a flexible strip having an upper surface 180 and a lower surface 182 separated by a thickness T. The locking member 120 has a central portion 186 that has a generally concave shape and that extends between end portions 188 and 190 that downwardly extend from bends 192. The central portion may include one or more bends 194. The bends 194 facilitate distribution of the biasing load B across the card edge module 102 (see FIG. 1) to bias the card edge module toward the slot 160 in the housing 124. Each end portion 188 and 190 includes an opening 198 sized to receive one of the protrusions 176 on the latch members 140. A slot 202 is formed at each bend 192. The slots 202 are sized to receive a portion of the substrate 144. A tab 204 is provided on each end portion 188 and 190 for manipulation of the locking member 120. The locking member 120 may be fabricated from a spring hardened metal material. In one embodiment, the locking member 120 is stamped and formed from a metallic material. In the exemplary embodiment, the locking member 120 comprises a spring clip fabricated from a spring hardened stainless steel.

Figure 3:
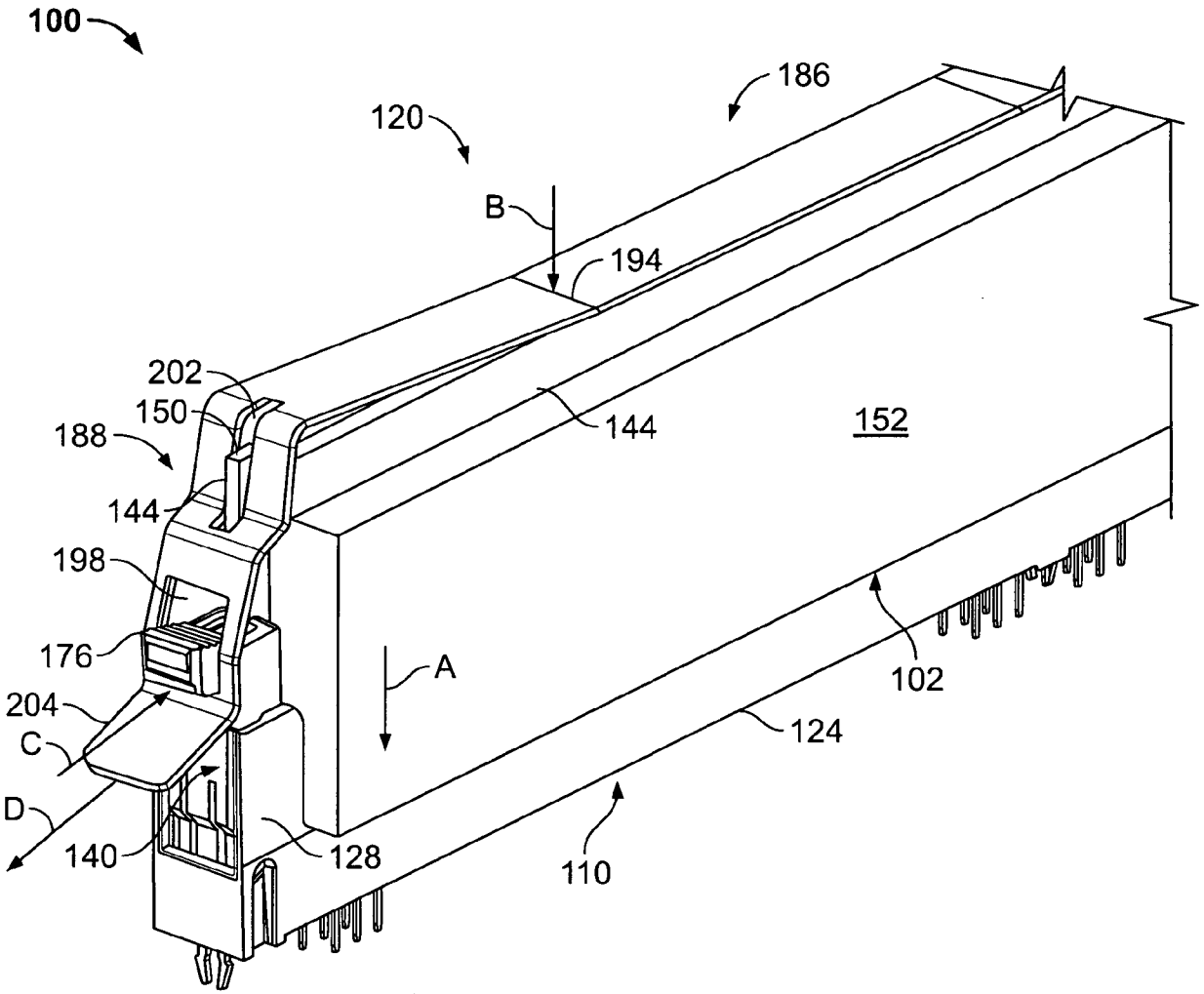
FIG. 3 is an enlarged fragmentary view of one end of the electronic assembly shown in FIG. 1.

FIG. 3 illustrates an enlarged fragmentary view of one end of the electronic assembly 100 as is shown in FIG. 1. FIG. 3 is representative of both ends of the assembly 100. In the completed assembly, the mating edge 146 (FIG. 2) of the card edge module 102 is inserted in the slot 160 (FIG. 2) of the housing 124. The latch member 140 is pivoted to the closed position to retain the card edge module 102 in the housing 110. The locking member 120 is positioned on the latch member 140 to prevent movement of the latch member 140 from the closed position to the open position so that the card edge module 102 cannot become dislodged from the connector 110. More specifically, the locking member 120 is positioned on both of the closed latch members 140 such that the protrusions 176 on the latch members 140 are received in respective openings 198 in the locking member 120. The locking member 120 thereby engages the latch members 140 at the ends 128 and 130 of the connector 110 and applies inward longitudinal loads C to prevent movement of the latch members 140 from the closed position to the open position.

When the locking member 120 is positioned on the latch members 140, the end portions 188 and 190 (FIG. 2) are pushed downward toward the connector 110 so the protrusions 176 on the latch members 140 snap into the openings 198 and the central portion 186 of the locking member 120 engages the upper edge 150 of the substrate 144 to apply the biasing load B. More particularly, when bends 194 are formed in the central portion 186, the bends engage the upper edge 150 of the substrate 144 to distribute the biasing load B. A corner portion of the substrate 144 is received in the slots 202 to inhibit lateral movement of the card edge module 102 in the connector 110 to further stabilize the card edge module 102 in the connector 110. The locking member 120 is removed from the latch members 140 by simultaneously moving the tab 204 downward in the loading direction A and laterally outward in the direction of the arrow D to disengage the protrusions 176 from the openings 198. This allows the locking member 120 to be removed from the latch members 140, thereby enabling movement of the latch members 140.

Figure 4:
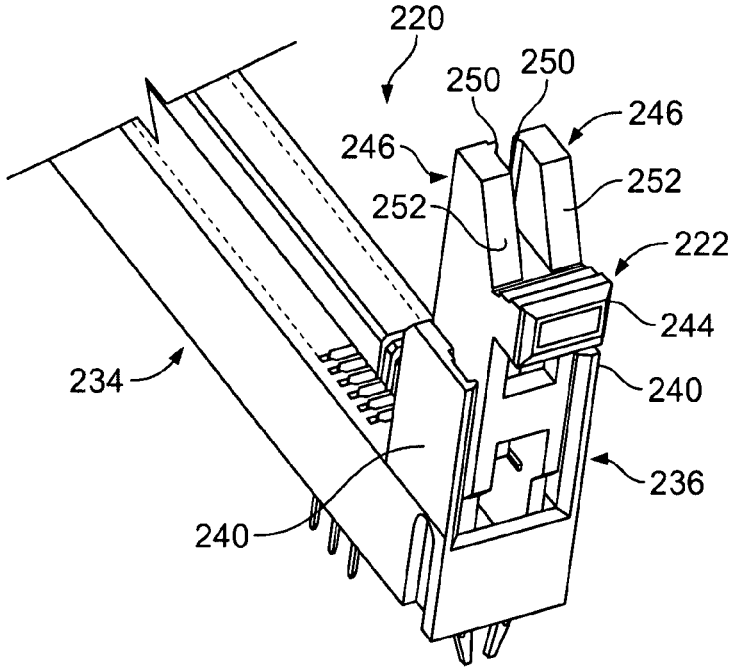
FIG. 4 is a fragmentary perspective view of a connector including an alternative embodiment of a latch member suitable for use with the locking member shown in FIG. 1.
Figure 5:
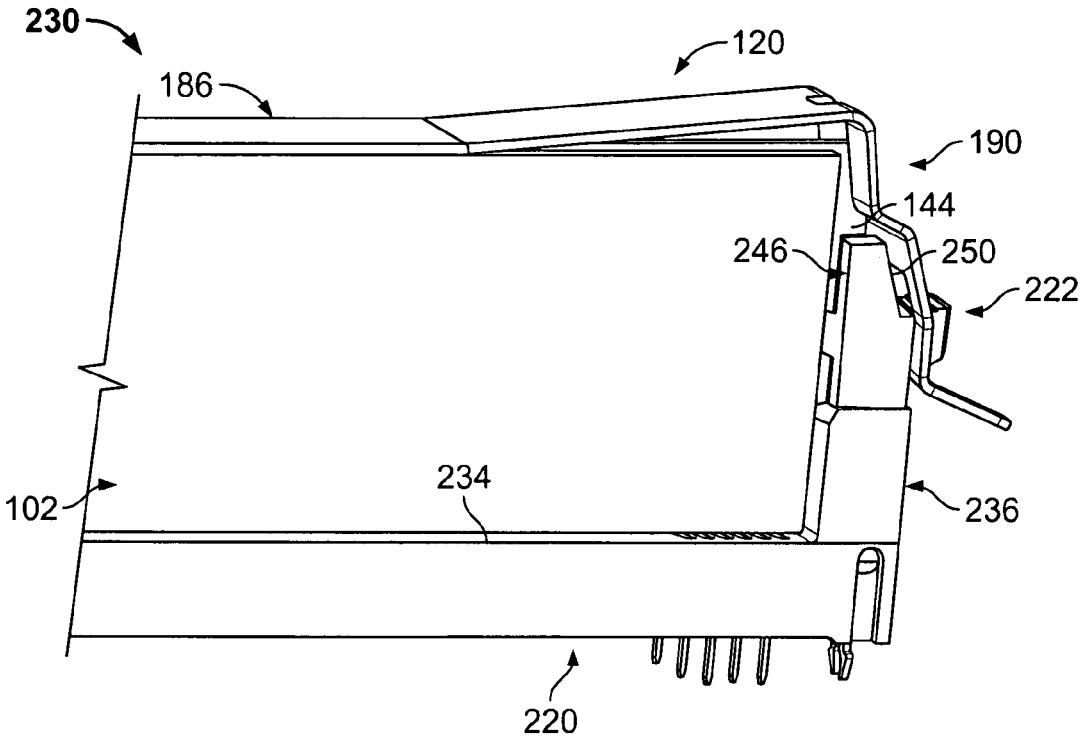
FIG. 5 is a fragmentary front elevational view of an electronic assembly including the latch member shown in FIG. 4.

FIG. 4 illustrates a fragmentary view of a socket connector 220 including an alternative latch member 222 suitable for use with the locking member 120. FIG. 5 illustrates a fragmentary front elevational view of an electronic assembly 230 that includes the card edge module 102, the locking member 120, and the socket connector 220 that includes the latch member 222. The connector 220 includes a housing 234 that extends between opposite ends 236, only one of which is shown in FIG. 4. The housing 234 and ends 236 are identical to the housing 124 and the ends 128, 130 previously described; and, detailed descriptions of the housing 234 and ends 236 are omitted. The latch member 222 is positioned between side panels 240 of the connector end 236 and is pivotably connected to the connector end 236.

The latch member 222 includes a protrusion 244 that extends outwardly from the latch member 222 and is provided for manipulation of the latch member 222 between an open position and a closed position. Opposed arms 246 extend upwardly from the protrusion 244 and are spaced apart sufficiently to receive a portion of the substrate 144 of the card edge module 102. The arms 246 include crush ribs 250 that are configured to engage a portion of the substrate 144 to stabilize the card edge module 102 in the connector. The arms 246 include outer surfaces 252 that are contoured to provide clearance for the end portion 190 of the locking member 120. In the illustrated embodiment, the arms 246 include sloped outer surfaces 252.

Figure 6:
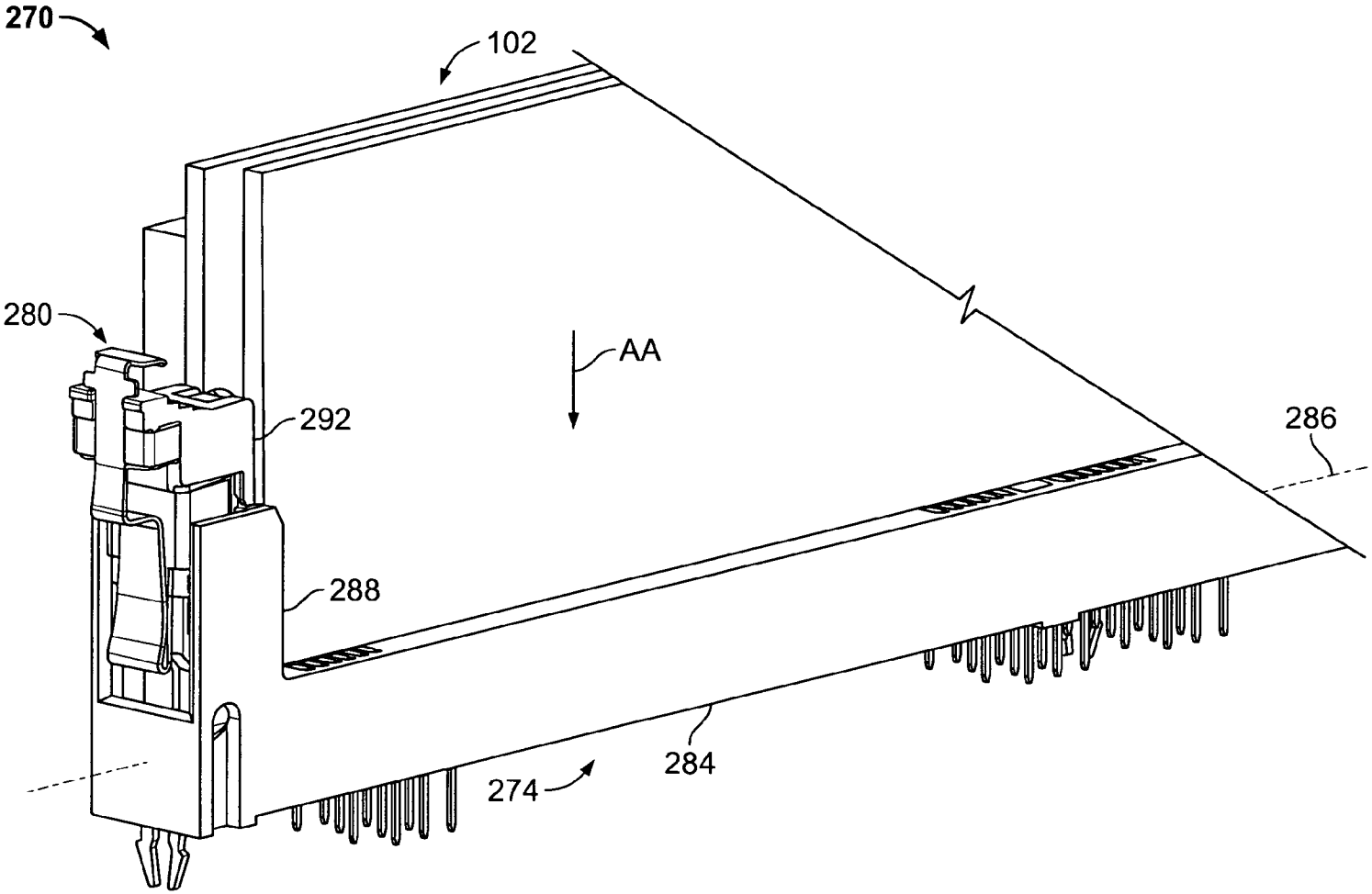
FIG. 6 is a fragmentary perspective view of an electronic assembly including a socket connector and locking member formed in accordance with an alternative embodiment of the present invention.

FIG. 6 illustrates a partial perspective view of an electronic assembly 270 including the card edge module 102 held in a socket connector 274 with a locking member 280 formed in accordance with an alternative embodiment of the present invention. The card edge module 102 is as previously described. The connector 274 includes a dielectric housing 284 that extends along a longitudinal axis 286 between first and second opposite ends 288, only one of which is shown in FIG. 6. A latch member 292 is pivotably connected to the housing 284 at each end 288. The latch members 292 are pivotable between an open position and a closed position. The card edge module 102 is loaded into the connector 274 in the direction of the arrow AA when the latch members 292 are in the open position. The card edge module 102 is held in the connector 274 when the latch members 292 are in the closed position as shown. The locking member 280 is positioned on the latch member 292 and is configured to prevent movement of the latch member 292 from the closed position to the open position to thereby prevent dislodgement of the card edge module 102 from the socket connector 274. More specifically, the locking member 280 is slidably mounted on the latch member 292 and is movable between a locked position wherein movement of the latch member 292 is inhibited and an unlocked position wherein movement of the latch member 292 is enabled, as will be described. As illustrated in FIG. 6, the locking member is in the locked position.

Figure 7:
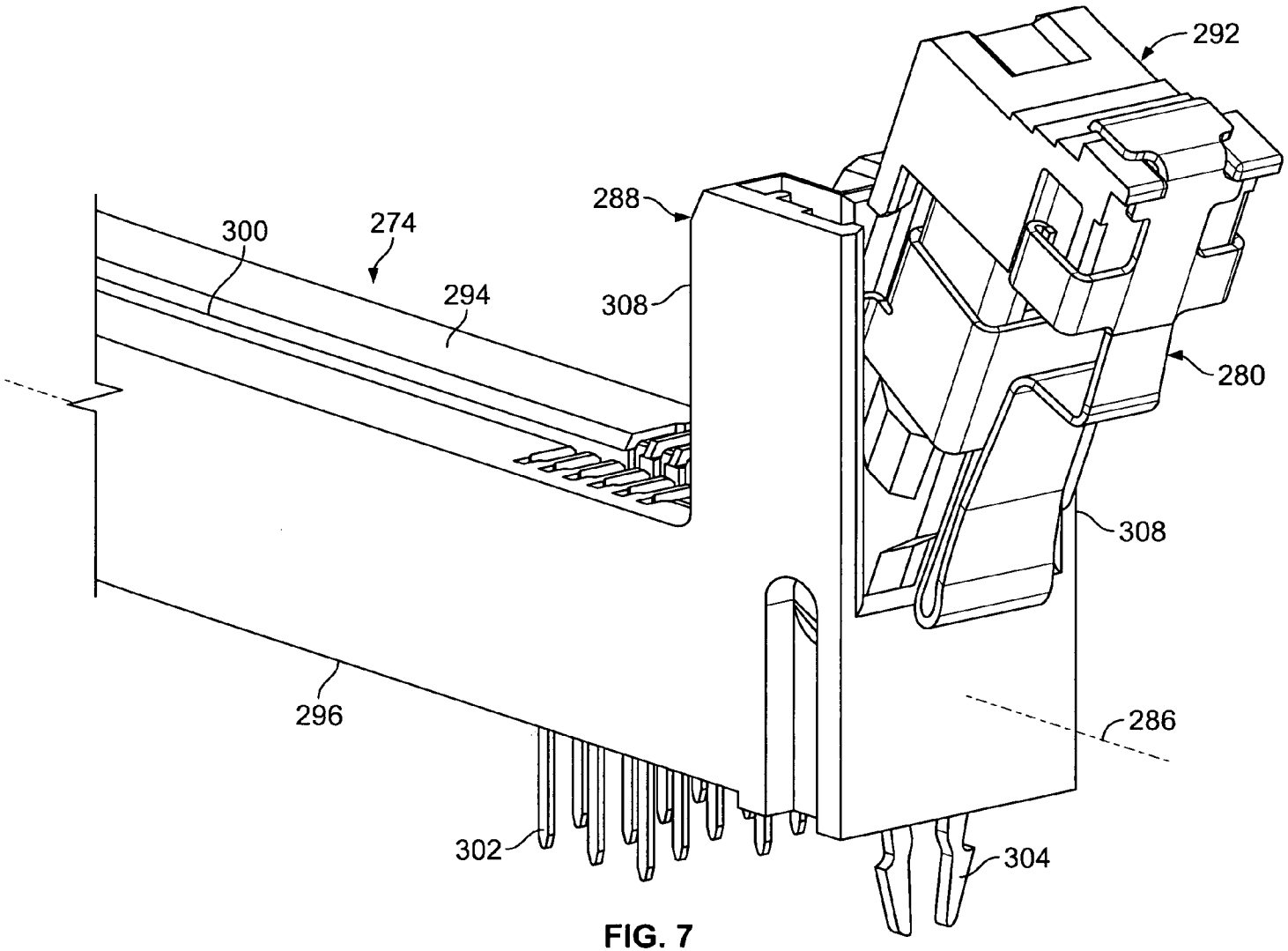
FIG. 7 is a fragmentary perspective view of the socket connector and locking member shown in FIG. 6 with the card edge module removed.

FIG. 7 illustrates a partial perspective view of the socket connector 274 and locking member 280 with the card edge module 102 (FIG. 6) removed. The locking member 280 is shown in the unlocked position allowing the latch member 292 to be rotated to the open position. The housing 284 of the connector 274 includes an upward facing mating face 294 and a mounting face 296. The housing 284 includes a longitudinally extending slot 300 that is configured to receive the mating edge 146 of the card edge module 102 (see FIG. 2). The housing 284 holds a plurality of electrical contacts 302 arranged in rows on each side of the slot 300. In some embodiments, the housing 284 may also include board locks 304 for securing the connector 274 to the circuit board 142. The connector end 288 includes upwardly extending and spaced-apart side panels 308. The latch member 292 is positioned between the side panels 308 and is pivotably connected to the connector end 288.

Figure 8:
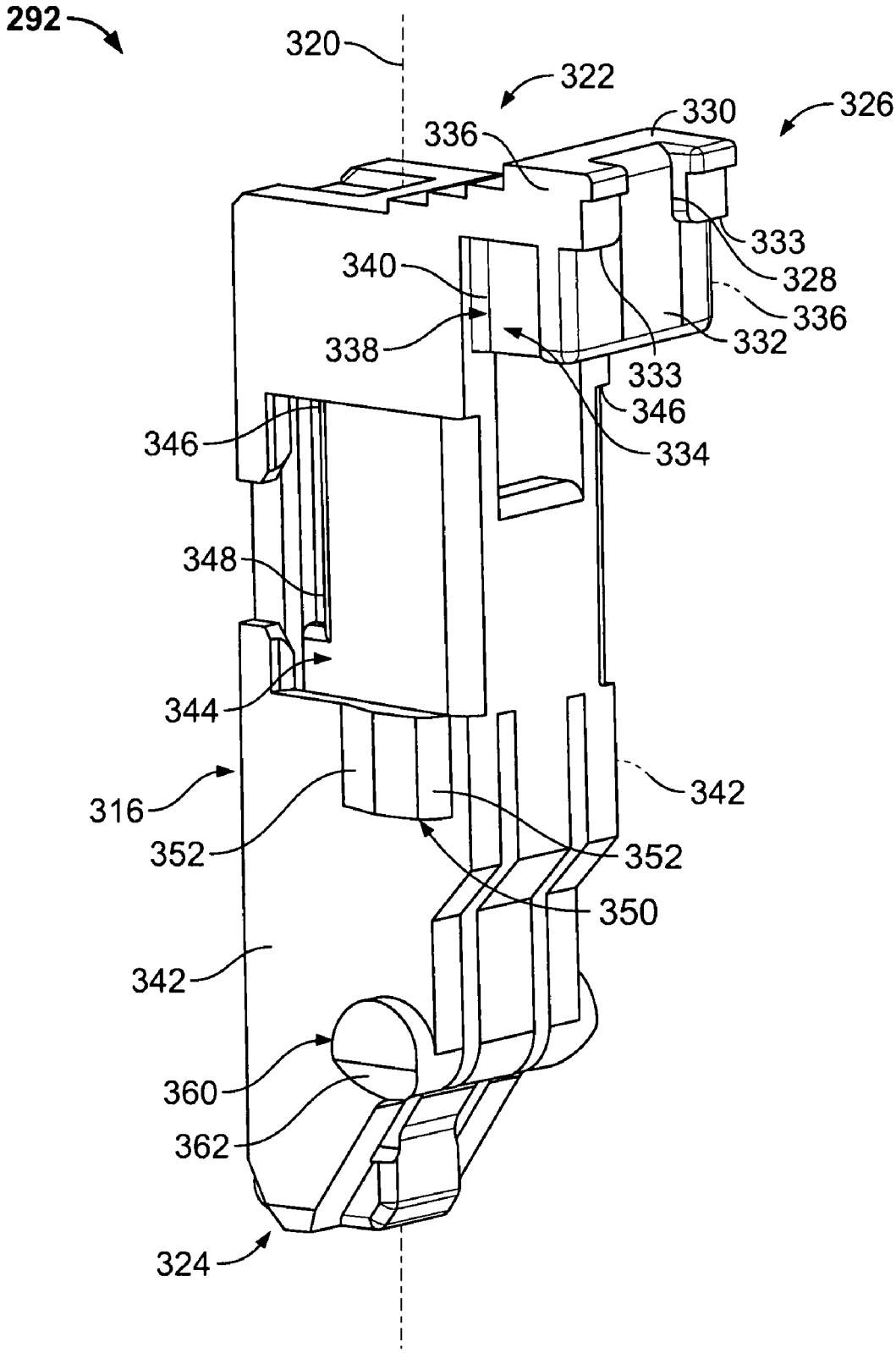
FIG. 8 is a perspective view of the latch member shown in FIG. 6.

FIG. 8 illustrates a perspective view of the latch member 292. The latch member 292 includes a body 316 that extends along a longitudinal axis 320 between an upper end 322 and a pivot end 324. A protrusion or thumb pad 326 extends from the body 316 proximate the upper end 322. The protrusion 326 includes a notch 328 that extends to an upper surface 330. A bottom of the notch 328 is coextensive with a surface 332 that is undercut to form downward facing ledges 333. An upper recess 334 is formed in sides 336 of the protrusion 326. A channel 338 having side walls 340 is formed in the upper recess 334. The body 316 includes sides 342. A central recess 344 is formed in each side 342. The central recess 344 defines ledges 346. A channel 348 is formed in the recess 344. A projection 350 is formed on each side 342. The projections 350 include beveled surfaces 352. The projections 350 engage inner surfaces of the connector end 288 (FIG. 7) when the latch member 292 is closed to retain the latch members 292 in the closed position. Pivot posts 360 extend from each side 342 to mount or connect the latch member 292 to the connector end 288. The pivot posts 360 are substantially circular in cross section to facilitate a rotatable connection of the latch members 292 to the connector end 288. The pivot posts 360 are provided with beveled surfaces 362 to facilitate assembly of the latch members 292 into the connector end 288.

Figure 9:
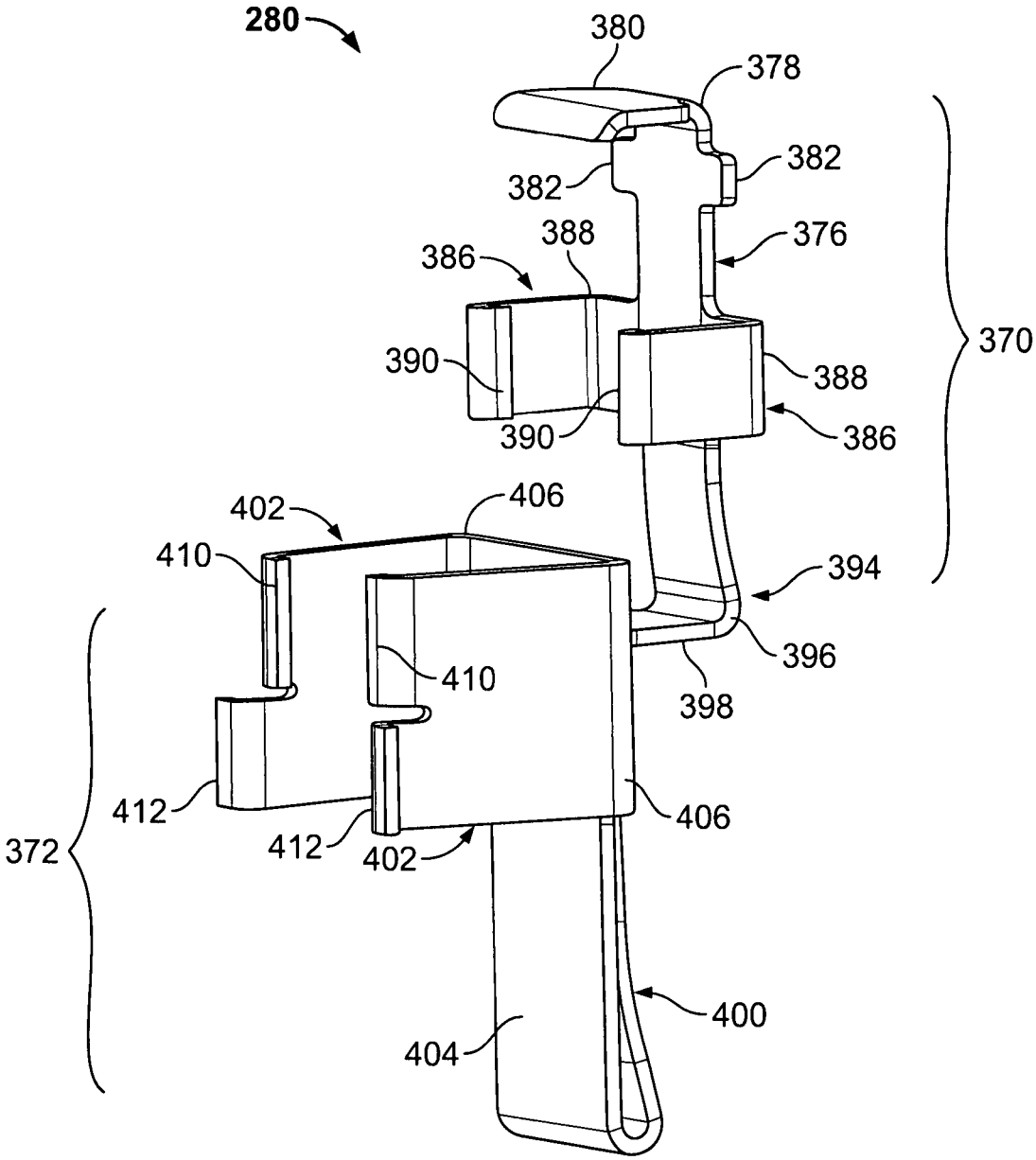
FIG. 9 is a perspective view of the locking member shown in FIG. 6.

FIG. 9 is a perspective view of the locking member 280. The locking member includes an upper portion 370 and a lower portion 372. The upper portion 370 includes a vertically extending center strip 376 having an upper bend 378. A tab 380 extends from the upper bend 378. Stop tabs 382 project sidewardly from the center strip 376 below the upper bend 378. Upper attachment arms 386 extend from the center strip 376 and are formed with bends 388 so that the upper attachment arms 386 project substantially in the direction of the tab 380. Each upper attachment arm 386 terminates in an inwardly turned lip 390. A lower end 394 of the center strip 376 is formed with a bend 396 and a lift tab 398. A looped portion 400 joins the lower portion 372 with the lift tab 398. The looped portion 400 imparts some compliancy or flexibility between the upper and lower portions 370 and 372, respectively. Lower attachment arms 402 are formed on an inward side 404 of the looped portion 400. The lower attachment arms 402 include bends 406 that orient the lower attachment arms 402 in substantially the same direction as the upper attachment arms 386. Each lower attachment arm 402 terminates in an inwardly turned lip 410 and an outwardly turned lip 412. In one embodiment, the locking member 280 is stamped and formed from a metallic material. In the exemplary embodiment, the locking member 280 may be fabricated from spring tempered steel.

Figure 10:
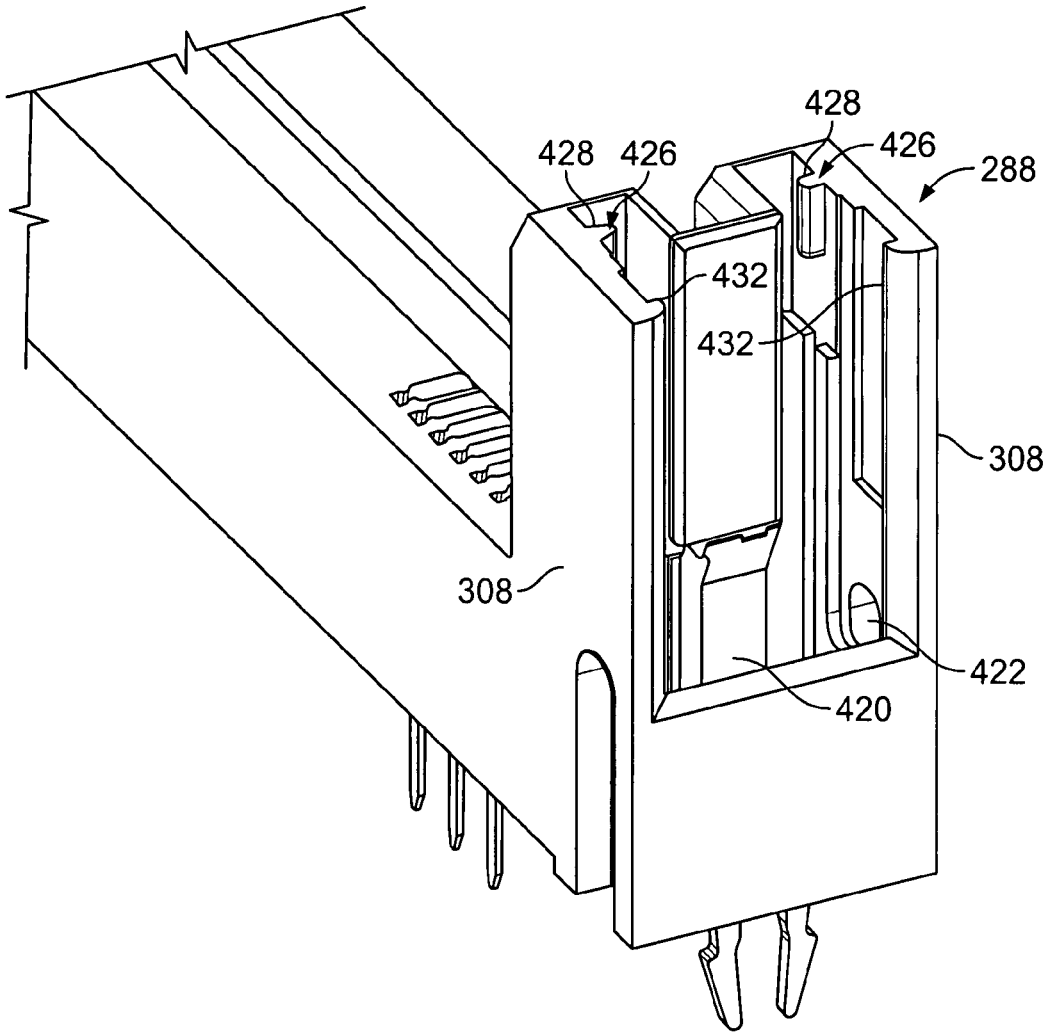
FIG. 10 is a perspective view of the socket connector end shown in FIG. 7.

FIG. 10 is a perspective view of the socket connector end 288. The connector end 288 includes a cavity 420 that receives the assembled latch member 292 (FIG. 8) and locking member 280 (FIG. 9). Apertures 422, only one of which is visible in FIG. 10, are provided to receive the pivot posts 360 on the latch member 292 to rotatably connect the latch member 292 to the connector end 288. A protrusion 426 having an engagement surface 428 is formed on an interior surface of each side panel 308. Ridges 432 are formed on the side panels 308 at the opening of the cavity 420.

With continued reference to FIGS. 8, 9 and 10, FIG. 11 is a perspective view of the locking member 280 mounted on the latch member 292. The assembled latch member 292 and locking member 280 are received in the cavity 420 in the connector end 288. When the locking member 280 is mounted on the latch member 292, the upper attachment arms 386 are received in the upper recesses 334 of the latch member 292 with the inwardly turned lips 390 received in the channels 338. The lower attachment arms 402 of the locking member 280 are received in the central recesses 344 of the latch member 292 with the inwardly turned lips 410 received in the channels 348. The channels 338 and 348 guide the movement of the locking member 280 on the latch member 292.

Figure 11:
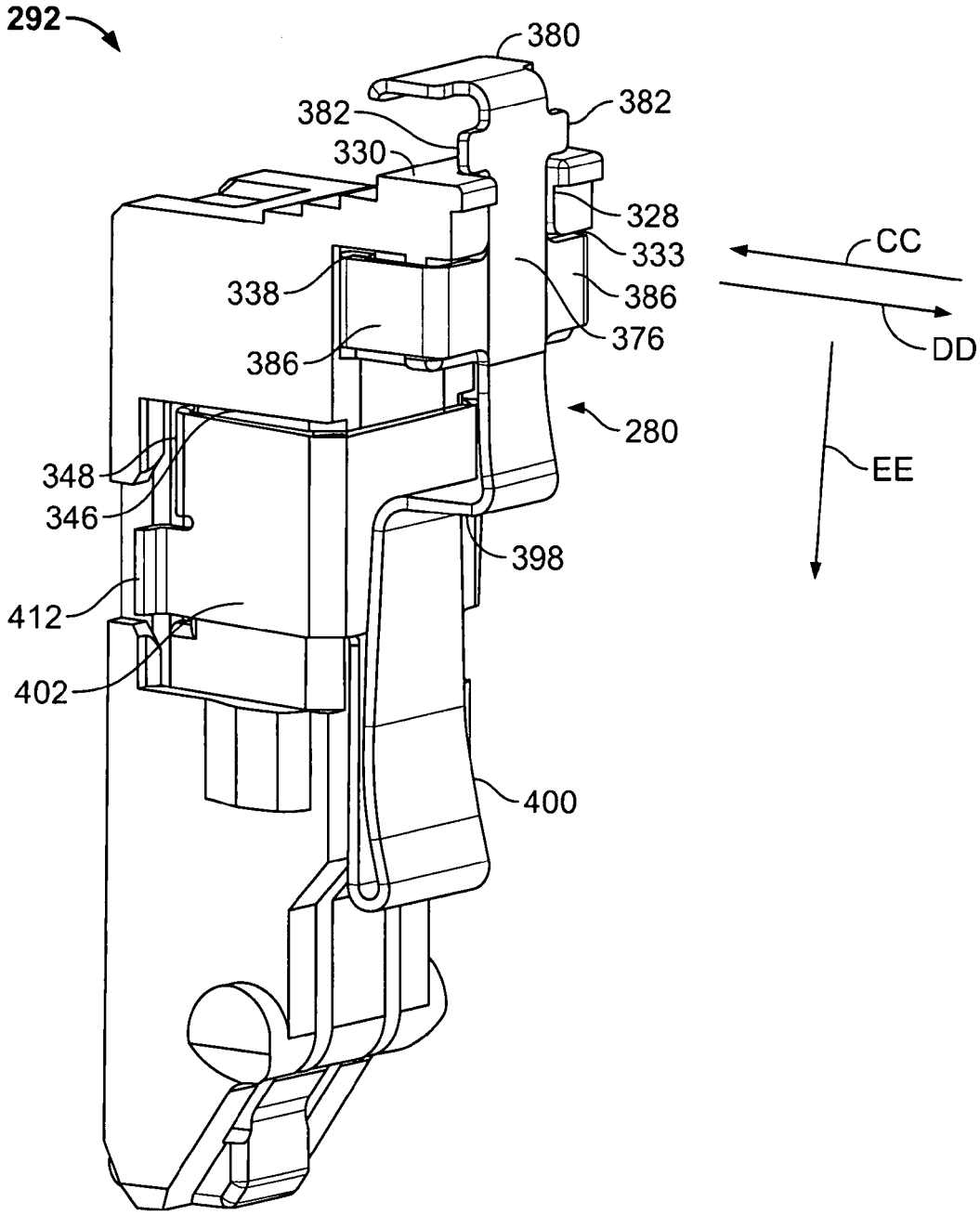
FIG. 11 is a perspective view of a locking member and latch member assembly.

The locking member 280 is slidable on the latch member 292 between an uppermost locked position as shown in FIG. 11 (see also FIG. 6) wherein rotation of the latch member 292 is inhibited and a lowermost unlocked position (see FIG. 7) wherein rotation of the latch member 292 is enabled. When mounted on the latch member 292, the upper portion 370 of the locking member 280 is biased horizontally toward the latch member 292 in the direction of the arrow CC.

Upward thumb pressure may be applied to the lift tab 398 to move the locking member 280 to its uppermost or locked position on the latch member 292. When the locking member 280 is moved to the locked position, the outwardly turned lips 412 on the lower attachment arms 402 are positioned to engage the engagement surfaces 428 of the protrusions 426 on the side panels 308 of the connector end 288. In this manner, rotation of the latch member 292 is inhibited.

In the locked position, the center strip 376 of the locking member 280 is received in the notch 328 and the stop tabs 382 rest on the upper surface 330 on the latch member 292 to prevent the inadvertent downward movement of the locking member 280. The upper attachment arms 386 engage the ledges 333 and the lower attachment arms 402 engage the ledges 346 to limit the upward travel of the locking member 280.

In order to unlock the locking member 280 the tab 380 is pushed laterally in the direction of the arrow DD and simultaneously downwardly in the direction of the arrow EE so that the locking member 280 slides downwardly on the latch member 292. When the locking member 280 is moved to the unlocked position, the outwardly turned lips 412 on the lower attachment arms 402 are positioned below the protrusions 426 on the side panels 308 of the connector end 288. In this manner, rotation of the latch member 292 is enabled. The inwardly turned lips 390 on the upper attachment arms 386 engage the side walls 340 of the channels 338 to prevent over stressing of the locking member 280 when the tab 380 is moved laterally in the direction of the arrow DD. The tab 380 engages the upper surface 330 on the latch member 292 to limit downward travel of the locking member 280. When the latch member 292 is opened, the outwardly turned lips 412 on the lower attachment arms 402 engage the ridges 432 on the connector end 288 to limit the rotation of the latch member 292. When the latch member 292 and locking member 280 are installed in the connector end 288, the downward direction EE is identical to the loading direction AA (FIG. 6) of the card edge module 102 in the connector 274 and the lateral direction DD is parallel to the longitudinal axis 286.

The embodiments thus described provide a socket connector 110, 274 including locking members 120, 280 that are positioned on the latch members 140, 292 to prevent the latch members from being moved to the open position to thereby prevent dislodgement of the card edge module 102 from the connector 110. In one embodiment, the locking member 120 is a spring clip having openings 198 that receive protrusions or thumb pads 176 on the latch member 140. This embodiment requires no special features on the connector 110, and thus may be used with an existing connector. In an alternative embodiment, the locking member 280 is slidably mounted on the latch member 292 and is slidable between locked and unlocked positions. In the locked position, a lip on the locking member 280 engages an interior engagement surface in the connector end 288 to prevent opening of the latch member 292.

While the invention has been described in terms of various specific embodiments, those skilled in the art will recognize that the invention can be practiced with modification within the spirit and scope of the claims.

What is claimed is:

1. A socket connector for connecting a card edge module to a circuit board, said socket connector comprising:

a housing extending along a longitudinal axis between opposed ends, the housing including a mounting face configured to be received on the circuit board and a slot configured to receive a mating edge of the card edge module;

a latch member pivotably connected to said housing, said latch member being movable between an open position and a closed position, said latch member comprising a protrusion; and a locking member positioned on said latch member and configured to prevent movement of said latch member from the closed position to the open position, wherein said locking member includes an opening sized to receive said protrusion.

2. The socket connector of claim 1, wherein said latch member includes a first latch member at one of said opposed ends of said housing and a second latch member at the other of said opposed ends of said housing and wherein said locking member engages said first and second latch members to prevent movement of said first and second latch members from the closed position to the open position.

3. The socket connector of claim 1, wherein said locking member includes a slot sized to receive a portion of the card edge module.

4. The socket connector of claim 1, wherein said locking member is configured to apply a downward load on the card edge module to bias the card edge module toward said slot.

5. The socket connector of claim 1, wherein said latch member includes arms that extend upwardly from said protrusion, said arms including crush ribs that engage the card edge module to stabilize the card edge module in the connector.

6. A socket connector for connecting a card edge module to a circuit board, said socket connector comprising:

a housing extending along a longitudinal axis between opposed ends, the housing including a mounting face configured to be received on the circuit board and a slot configured to receive a mating edge of the card edge module;

a latch member pivotably connected to said housing, said latch member being movable between an open position and a closed position; and a locking member positioned on said latch member and configured to prevent movement of said latch member from the closed position to the open position, wherein said locking member is mounted on said latch member and is slidable between a locked position and an unlocked position.

7. The socket connector of claim 6, wherein each of said opposed ends includes a protrusion having an engagement surface and said locking member includes a lip that engages said engagement surface when said locking member is in the locked position.

8. The socket connector of claim 6, wherein said latch member includes guide channels and said locking member includes lips that are received in said guide channels.

9. The socket connector of claim 6, wherein said locking member includes upper and lower attachment arms that partially surround said latch member and said latch member includes recesses sized to receive said attachment arms.

10. The socket connector of claim 6, wherein said locking member includes an upper portion, a lower portion and a looped portion joining said upper and lower portions, said looped portion provided to impart flexibility between said upper and lower portions.

11. A socket connector for connecting a card edge module to a circuit board, said socket connector comprising:

a housing extending along a longitudinal axis between opposed ends, the housing including a mounting face configured to be received on the circuit board and a slot configured to receive a mating edge of the card edge module in a loading direction;

a latch member pivotably connected to said housing, said latch member being movable between an open position and a closed position; and a locking member positioned on said latch member, said locking member including a tab that is moved simultaneously in the loading direction and a longitudinal direction to enable said latch member to be moved to the open position.

12. The socket connector of claim 11, wherein said latch member includes a first latch member at one of said opposed ends of said housing and a second latch member at the other of said opposed ends of said housing and wherein said locking member engages said first and second latch members to prevent movement of said first and second latch members from the closed position to the open position.

13. The socket connector of claim 11, wherein said locking member includes an opening sized to receive a protrusion on said latch member.

14. The socket connector of claim 11, wherein said locking member includes a slot sized to receive a portion of the card edge module.

15. The socket connector of claim 11, wherein said locking member is configured to apply a downward load on the card edge module to bias the card edge module toward said slot.

16. The socket connector of claim 11, wherein said locking member is mounted on said latch member and is slidable between a locked position and an unlocked position.

17. The socket connector of claim 16, wherein each of said opposed ends includes a protrusion having an engagement surface and said locking member includes a lip that engages said engagement surface when said locking member is in the locked position.

18. The socket connector of claim 11, wherein said latch member includes guide channels and said locking member includes lips that are received in said guide channels.

19. The socket connector of claim 11, wherein said locking member includes an upper portion, a lower portion and a looped portion joining said upper and lower portions, said looped portion provided to impart flexibility between said upper and lower portions.

* * * * *